United States Patent [19]

Taylor

[11] 4,333,542

[45] Jun. 8, 1982

[54] DOWNHOLE FISHING JAR MECHANISM

[76] Inventor: William T. Taylor, P.O. Box 309, Warren, Tex. 77664

[21] Appl. No.: 117,308

[22] Filed: Jan. 31, 1980

[51] Int. Cl.[3] ..... E21B 4/06

[52] U.S. Cl. ..... 175/299; 175/302

[58] Field of Search ..... 175/299, 300, 302, 303, 175/304; 267/125; 294/86.27

[56] References Cited

U.S. PATENT DOCUMENTS

| | | | |
|---|---|---|---|
| 1,989,906 | 2/1935 | Beck | 175/302 |
| 2,122,751 | 7/1938 | Phipps | 175/299 |
| 2,166,299 | 7/1937 | Kennedy et al. | 175/299 |
| 2,634,102 | 4/1953 | Howard | 175/299 |
| 2,882,018 | 4/1959 | Andrews | 175/299 |
| 3,880,249 | 4/1975 | Anderson | 175/302 |

*Primary Examiner*—William F. Pate, III

*Attorney, Agent, or Firm*—Guy E. Matthews

[57] ABSTRACT

A downhole fishing jar mechanism for freeing stuck objects within a well bore which incorporates a housing structure defining an internal anvil element through which an upwardly-directly impact force is adapted to be transmitted to the body structure. A striker element, incorporated with an elongated operator element is adapted to strike the anvil with an impact force that is controlled by means of an adjustable compression spring. A spherical detente-type latching mechanism is adapted to establish a releasable interconnection with the operator element and further is operative to transmit the compression of the spring to the operator element. The latch mechanism releases automatically upon predetermined upward movement of the operator element and latch mechanism within the body structure, thereby allowing the operator element to move upwardly and cause the striker to impart a predetermined impact force to the anvil. The latch mechanism is capable of being automatically reset upon simple downward movement of the operator element, thus promoting repetitive jarring simply by controlled upward and downward movement of the operator element through actuation of surface-controlled equipment.

27 Claims, 17 Drawing Figures

DOWNHOLE FISHING JAR MECHANISM

FIELD OF THE INVENTION

This invention relates generally to jarring apparatus such as is typically utilized within a well bore to free stuck objects therefrom. More specifically, the present invention is directed to a downhole fishing jar mechanism that is adapted to be connected above a fishing tool and which is operative to impart controlled impact forces to the stuck object regardless of the force that is applied to the fishing jar mechanism by surface-controlled equipment. Even more specifically, the present invention relates to a downhole fishing jar mechanism whereby an energy stroke to be applied to a stuck object may be accurately determined regardless of well conditions and the force of the impact to the stuck object can be adjusted very simply and accurately.

BACKGROUND OF THE INVENTION

During the drilling of deep wells, such as wells for producing petroleum products, objects such as drill pipe, tubing, well tools and other apparatus sometimes become stuck within the well bore and cannot be removed by application of ordinary upward force thereto. In such cases, it is frequently necessary to induce jarring forces to the stuck object in order to free it for extraction from the well bore. For purposes of this discussion, stuck objects are typically referred to in the industry as "fish," and operations that are conducted for removal of stuck or lost objects within a well bore are typically referred to as "fishing operations."

Jarring apparatus for inducing jarring forces to stuck objects take many different forms, depending upon the fishing operation to be conducted and typically involve two basic categories of jarring tools, i.e. hydraulically energized tools that are known as "oil jars" and mechanical jars. It is commonly known by all operators of deep well drilling and completion equipment that have had experience with any size oil jar on fishing operations in wells, that each well, having different characteristics, such as downhole pressure, hydrostatic head, temperature, friction, pipe stretch, deviated holes, etc., must be treated in specifically designed manner in order to accomplish an efficient fishing operation. Even fishing operations conducted in wells that are closely spaced and extend to a common oil producing subsurface formation have different characteristics that affect the function of oil jar mechanisms. It has been accepted by the well surface industry that it is practically impossible to calculate many of the foregoing well conditions and determine accurately the particular degree of energy stroke that is being imparted from an oil jar to a fish in any particular circumstance. For example, each well will have a particular bottom hole temperature that may be different from other wells and changes the density and viscosity of the oil within which the oil jar is located. Oil at higher temperature, of course, will be thinner and the viscosity thereof will be typically decreased at higher temperature ranges. In well bores that are more deviated, friction between the well bore and operating pipe or wire line typically increases and must be taken into consideration during fishing operations in order to determine the amount of force that is being applied through the oil jar mechanism. Further, where deep well bores are involved, the pipe or cable that supports the oil jar mechanism and the fishing tool will tend to have greater stretch simply due to the weight of the pipe or cable itself. When upwardly directed jarring forces are being applied through the supporting pipe or cable by surface control, the pipe or cable must be moved sufficiently to accommodate pipe stretch and yet apply a particularly designed jarring force to the fish.

A further disadvantage that is encountered through the use of oil jar mechanisms is the requirement to control the oil displacement that occurs within the oil jar tool. Under circumstances where oil jar mechanisms are closed rapidly, it is possible for the internal pressure within certain chambers of the oil jar to increase sufficiently to rupture the oil jar housing structure. From an operational standpoint, it is required that oil jars be carefully and slowly closed in order to induce slow displacement of the oil and thus eliminate the possibility of pressure energized rupture or explosion of the middle body on the oil jar. When operating an oil jar mechanism in a deep well where extensive cable or tubing stretch is involved, it is extremely difficult to accomplish slow closing of the oil jar mechanism. It is thus desirable to provide a fishing jar mechanism that can be opened and closed at any desirable speed without altering the characteristics of the energy stroke that is delivered to the fish.

THE PRIOR ART

Many different types of mechanical jarring tools have been developed for the purpose of loosening stuck objects or fish from well bores in order to accomplish extraction of the fish. In many cases, mechanical fishing jars employ lost motion connection between internal and external parts as in U.S. Pat. No. 2,872,158 of Green and many oil well jarring mechanisms employ compression springs for inducing the force of the jarring stroke as in U.S. Pat. No. 2,882,018 of Andrew, U.S. Pat. Nos. 3,208,541 and 3,233,690 of Lawrence, U.S. Pat. No. 3,360,060 of Kinley et al. and U.S. Pat. No. 3,406,770 of Arterberry et al. Further, many oil well jarring devices employ detent mechanisms for controlling the releasing force of striker mechanisms in order to control the jarring force, such as in U.S. Pat. No. 2,122,751 Phipps, U.S. Pat. No. 2,634,102 of Howard and U.S. Pat. No. 3,203,482 of Lyles.

In view of the foregoing, it is a primary feature of this invention to provide a novel mechanical downhole fishing jar mechanism that is adapted to induce a particular control application of jarring force to a fish, regardless of the particular force that is applied at the surface by means of surface controlled equipment.

It is an even further feature of this invention to provide a novel downhole fishing jar mechanism that is not subjected to internal friction such as by internal O-rings and other mechanical apparatus.

It is an even further feature of this invention to provide a novel downhole fishing jar mechanism that is adapted for rapid movement without developing hydraulic problems whether the jar mechanism is lubricant free or incorporates lubricant material to protect the internal parts thereof.

Among the several features of this invention is contemplated the provision of a novel downhole fishing jar mechanism that is not susceptible to burst or damage regardless of the particular upward or downward speed that is induced thereto by means of surface controlled operating equipment.

A further feature of this invention concerns a novel downhole fishing jar mechanism that functions efficiently without regard to various well conditions such as depth, temperature, density and viscosity of well fluid, hole deviation, etc., and allows accurately determined jarring forces to be transmitted to a fish regardless of such well conditions.

SUMMARY OF THE INVENTION

The present invention is directed to the provision of a downhole mechanical fishing jar mechanism for freeing stuck objects or fish within a well bore in order to allow extraction of the same. The fishing jar mechanism incorporates an elongated body structure or housing that is of hollow construction and defines an internal chamber that is adapted to receive an elongated operator mandrel element in linearly movable relation within the housing. The body structure is formed to define an internal anvil through which impact or jarring forces may be transmitted to the body structure and thence through an appropriate fishing tool to the fish that is stuck within the well bore. The operator mandrel is adapted at the upper extremity thereof for appropriate connection to apparatus for manipulating the fishing jar mechanism within a well bore. The tool manipulating apparatus may conveniently take the form of wire line control equipment or a tubing string, depending upon the characteristics that are involved. The operator mandrel is formed to define an internal flow passage, through which circulating fluid may be pumped in the event the apparatus is connected to a tubing string. The body structure of the fishing jar mechanism and other internal components thereof are also formed to define flow passage means through which circulating fluid is adapted to pass when fluid circulation is accomplished during fishing and jarring operations. Above the anvil structure, the body and mandrel cooperate to define a spring chamber within which is located a compression spring, the compression of which is adjustable by means of an adjustment nut that may be simply and easily adjusted by means of an appropriate adjustment tool. Below the anvil structure, the body is formed to define a pair of opposed internal grooves that are adapted to receive an elongated bifurcated element having an annular lower structure that surrounds the mandrel and from which a pair of elongated, transversely curved, load-transmitting elements extend through the elongated grooves and into the spring chamber for engagement with the lower extremity of the load spring. An annular elongated latch element, which is also referred to as a ball race, is located in movable relation within the housing structure with the upper portion thereof adapted to surround the lower extremity of the mandrel structure. The ball race is formed to define a plurality of detent apertures within which are received ball detents, with the detents also being partially receivable within an annular detent groove defined in the lower portion of the operator mandrel and functioning in such position to retain the operator mandrel in interlocked assembly with the latch device. The detent elements are also movable radially outwardly into upper and lower detent recess grooves defined within the body structure and, when so positioned, the interlocked relationship between the operator mandrel and the latch mechanism is released. The latch mechanism is urged upwardly by means of a compression spring but is readily movable downwardly under downward forces that are induced by the operator mandrel. The lower portion of the operator mandrel is formed to define an annular detent cam surface that is adapted to cam the detents outwardly into the lower body detent recess during resetting movement of the fishing jar mechanism.

Under circumstances where the jar mechanism is not intended to remain in the well for an extended period of time, it may be constructed in a form such that the internal parts thereof are subjected to well fluid. The jar mechanism then can be readily flushed to remove drilling mud and then flushed with protective lubricant to prevent corrosion of the internal parts. This feature allows construction of the jar mechanism without any necessity to provide O-rings and other sealing mechanisms that might retard free movement of the jar mechanism.

Under circumstances where the jar mechanism is to be subjected to extremely corrosive fluids or is to remain within the well for extended periods, such as during drilling operations for example, the jar mechanism may incorporate a sealed internal chamber within which the moving parts are exposed and this internal chamber may be filled with a protective liquid medium, such as silicon oil, to protect the internal parts from corrosion. By providing for volumetric fluid interchange and internal pressure balancing, the free movement aspect of the jar mechanism may be effectively maintained.

BRIEF DESCRIPTION OF THE DRAWINGS

So that the manner in which the above-recited features, advantages and objects of the present invention are attained and can be understood in detail, more particular description of the invention briefly summarized above may be had by reference to the embodiments thereof which are illustrated in the appended drawings, which drawings form a part of this specification.

It is to be noted, however, that the appended drawings illustrate only exemplary embodiments of this invention for accomplishment of the manufacturing process set forth herein and are therefore not to be considered limiting of the scope of the invention, for the invention may readily admit to other equally effective embodiments without departing from the spirit and scope of this invention.

In the Drawings:

FIG. 1 is an elevational view of a downhole fishing jar mechanism constructed in accordance with the present invention and illustrated as being positioned within a well casing and being interconnected with a fishing tool, illustrated in broken line.

FIG. 2 is a sectional view of the upper portion of the downhole fishing jar mechanism of FIG. 1, illustrating adjustment of the compression spring thereof.

Figure 1:
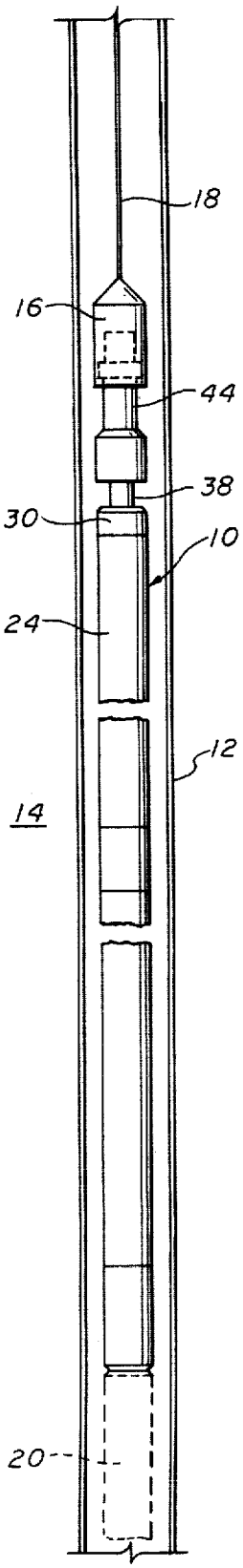
Figure 3A:
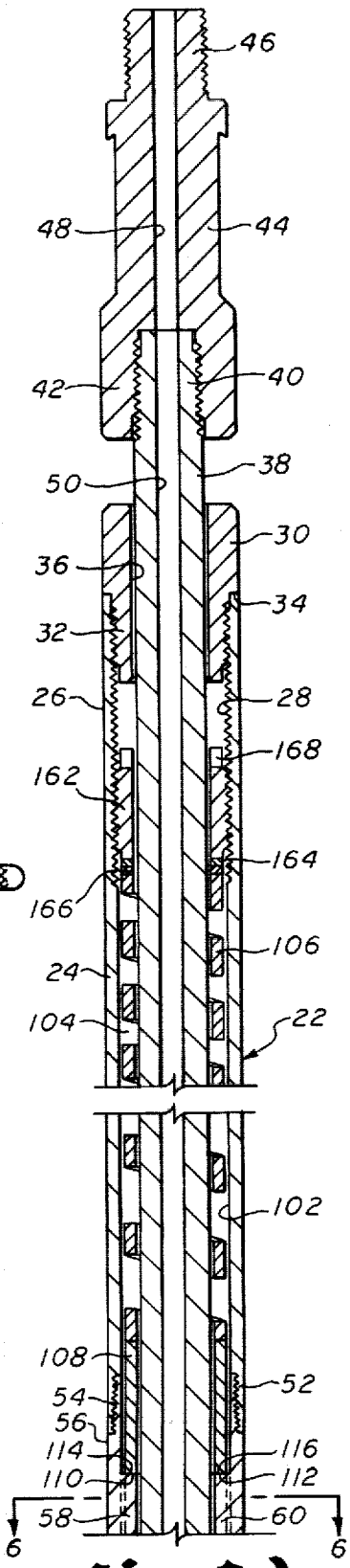

FIG. 3*a* is a sectional view of the upper portion of the downhole fishing jar mechanism of FIG. 1.

Figure 3B:
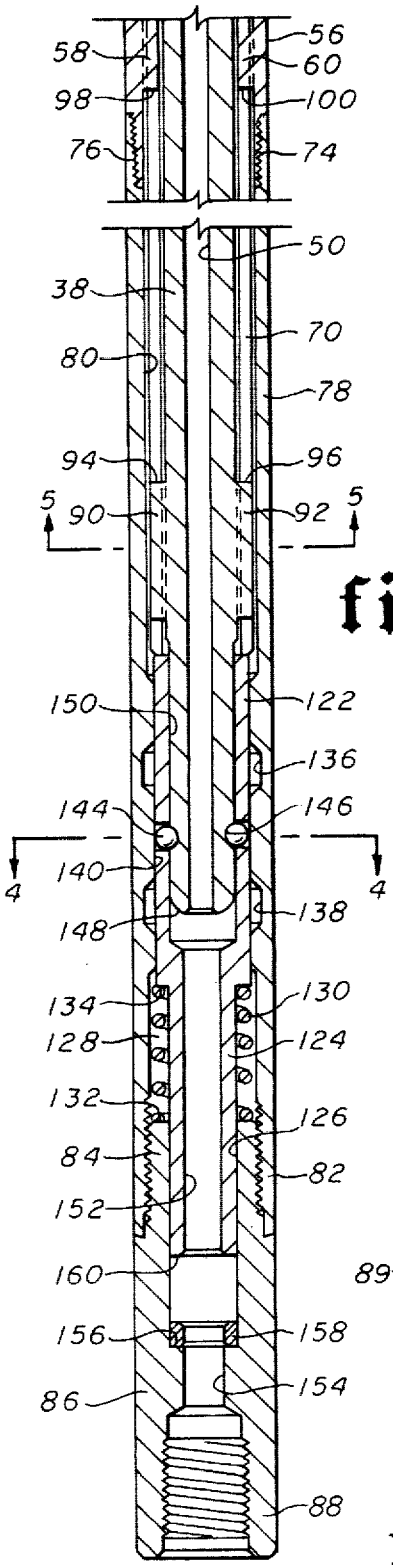

FIG. 3*b* is a sectional view of the lower portion of the downhole fishing jar mechanism of FIG. 1, illustrating the operator mandrel and latch mechanism in the interlocked relationship thereof, defining a set position of the jar mechanism.

Figure 3C:
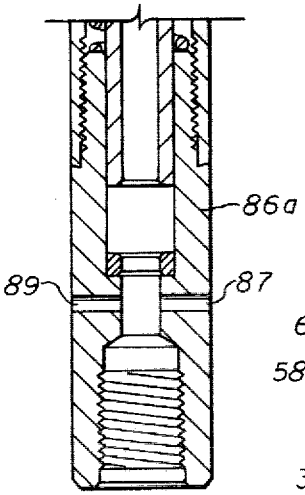

FIG. 3*c* is a fragmentary sectional view of a jar mechanism illustrating a pressure balance sub for wire-line controlled jarring operations.

Figure 4:
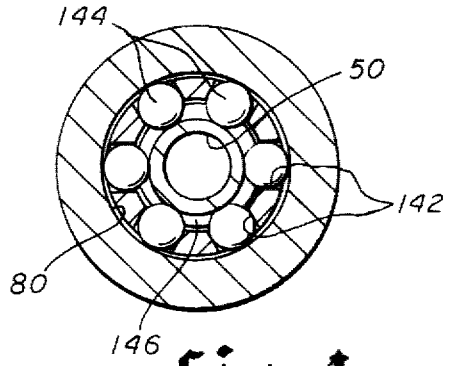

FIG. 4 is a sectional view taken along line 4—4 of FIG. 3*b* and illustrating the ball detent latching mechanism thereof in detail.

Figure 5:
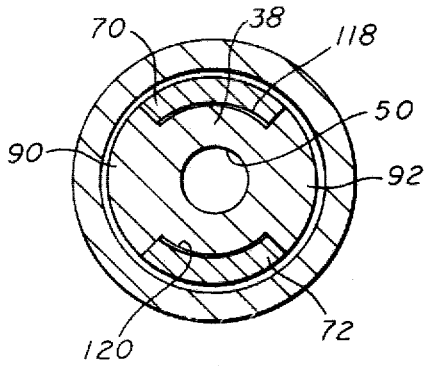

FIG. 5 is a sectional view taken along line 5—5 of FIG. 3*b* and illustrating the relationship of the load prongs and striker portion of the operator mandrel within the housing structure.

Figure 6:
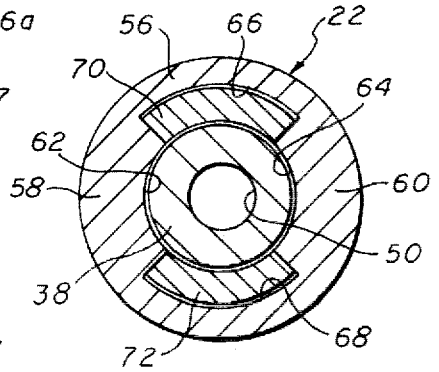

FIG. 6 is a sectional view taken along line 6—6 of FIG. 3a and illustrating the relationships of the load prong and operator mandrel to the housing structure.

Figure 7A:
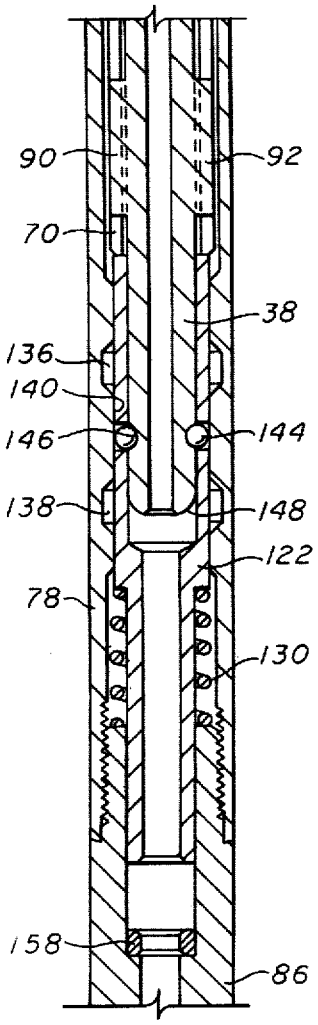

FIG. 7a is a sectional view of the lower portion of the downhole fishing jar mechanism of FIG. 1, illustrating the set position of the operator mandrel and latch element within the housing structure.

Figure 7B:
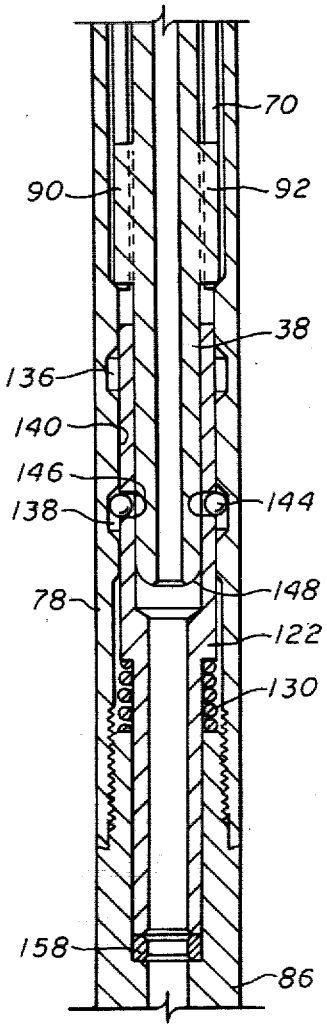

FIG. 7b is a sectional view similar to that of FIG. 7a and illustrating the position of the operator mandrel and latch elements during the resetting movement subsequent to a jarring operation.

Figure 7C:
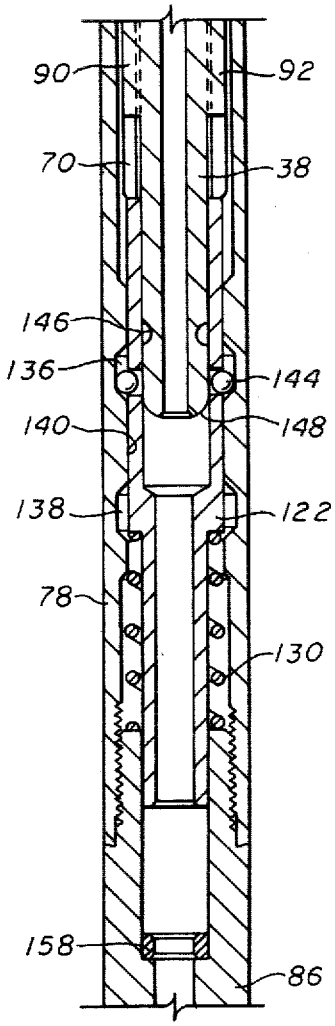

FIG. 7c is a sectional view similar to that of FIGS. 7a and 7b, illustrating release of the structural interconnection established by the detents between the operator mandrel and the latch element.

Figure 8A:
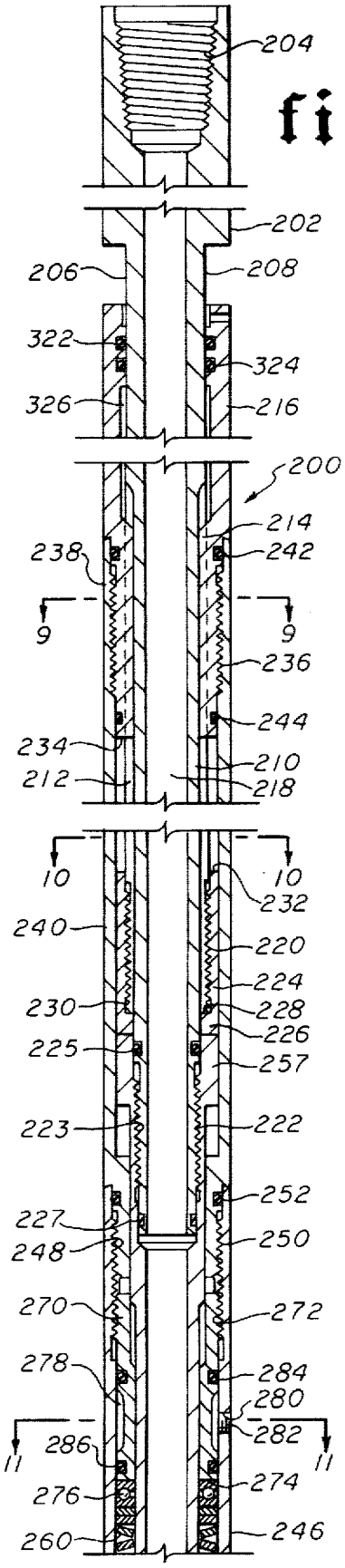

FIG. 8a is a sectional view of the upper portion of a downhole fishing jar mechanism representing an alternative embodiment of the present invention incorporating an oil filled protective chamber for corrosion protection of the internal parts thereof.

Figure 8B:
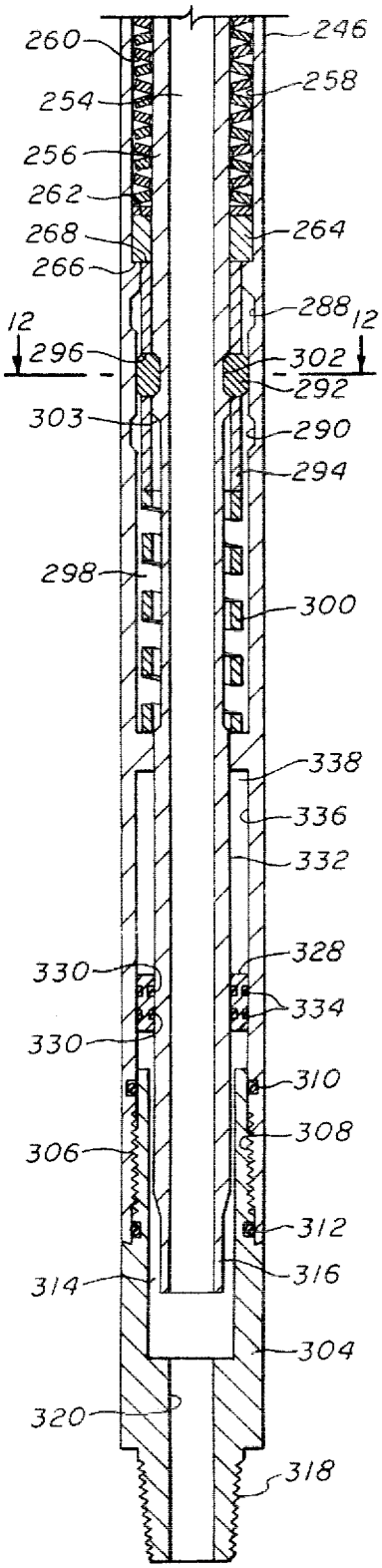

FIG. 8b is a sectional view of the lower portion of the fishing jar mechanism of FIG. 8a.

Figure 9:
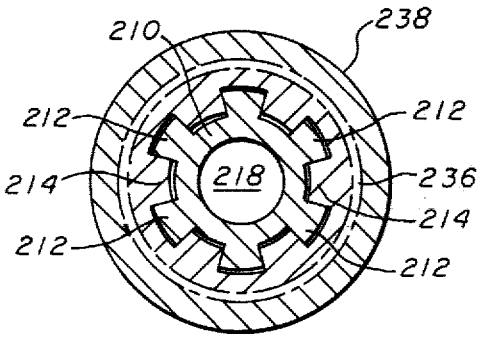

FIG. 9 is a transverse sectional view taken along line 9—9 of FIG. 8a.

Figure 10:
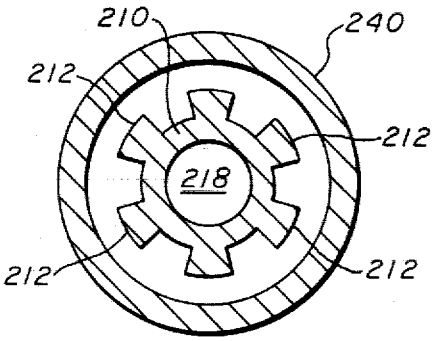

FIG. 10 is a transverse sectional view taken along line 10—10 of FIG. 8a.

Figure 11:
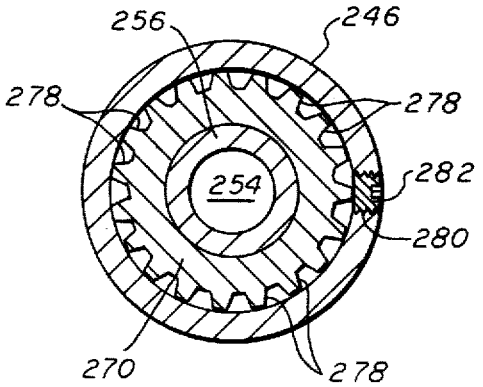

FIG. 11 is a transverse sectional view taken along line 11—11 of FIG. 8a.

Figure 12:
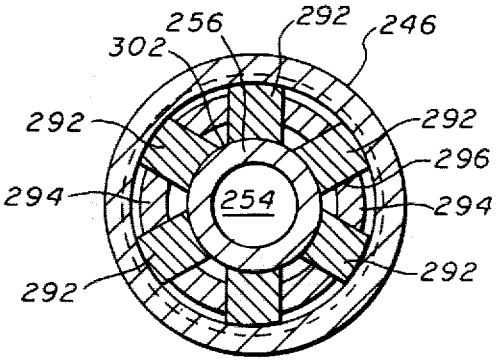

FIG. 12 is a transverse sectional view taken along line 12—12 of FIG. 8b.

DESCRIPTION OF PREFERRED EMBODIMENT

Referring now to to the drawings and first to FIG. 1, a downhole fishing jar mechanism constructed in accordance with the present invention is illustrated generally at 10 and is shown to be positioned within a well casing 12 that extends downwardly through earth formation 14. The fishing jar mechanism 10 is shown to be supported by a wire line tool 16 that is positioned within the well bore by means of a wire line 18 that is controlled by equipment provided at the surface of the well. The fishing jar mechanism is also shown to be connected to a fishing tool 20 that is shown in broken line and which is adapted to establish operative engagement with an object or fish that is stuck within the well casing or well bore.

Referring now particularly to FIG. 3a, the fishing jar mechanism 10 includes a housing structure illustrated generally at 22 with the housing structure being defined by an upper housing section 24 that is formed to define an internally threaded upper portion 26 defining internal threads 28 of considerable length. An upper cap 30 is provided having an externally threaded lower portion 32 that is adapted to be received by the upper portion of the internal thread 28 with an annular shoulder 34 seated against the upper extremity of the upper housing section. The cap member 30 is also formed to define an internal bore 36 through which an operator mandrel 38 extends into the housing. The upper extremity of the operator mandrel is formed to define an externally threaded section 40 that is adapted to be received in threaded engagement within an internally threaded lower portion 42 of a wire line connector sub 44. The upper portion of the sub 44 is formed by an externally threaded upper portion 46 which may be received by a tubing connector in the event the fishing jar mechanism is adapted to be operated by tubing during fluid circulation. The wire line adaptor 44 is also formed to define an internal flow passage 48 through which circulating fluid passes when jarring operations are conducted during fluid circulation. The mandrel 38 is also formed to define an internal passage 50 through which circulating fluid passes.

Referring now to the lower portion of FIG. 3a and the upper portion of FIG. 3b, the upper housing section 24 is formed to define an internally threaded lower extremity 52 that receives the externally threaded upper extremity 54 of an intermediate anvil section 56.

Referring now also to FIG. 6, along with FIGS. 3a and 3b, the anvil section 56 of the housing structure 22 is formed internally to define a pair of opposed anvils 58 and 60 that are formed integrally with the anvil section. The anvil structures 58 and 60 are formed internally to define partially cylindrical surfaces 62 and 64 that allow the cylindrical portion of the mandrel 38 to pass through the space or opening defined between the anvil structures. The anvil section is also formed internally to define a pair of opposed arcuate grooves 66 and 68 through which extend a pair of load prong elements 70 and 72 which are discussed in detail hereinbelow.

The lower portion of the anvil section 56 as shown in FIG. 3b is formed to define an externally threaded lower portion 74 that is adapted to receive the internally threaded upper portion 76 of a lower housing section 78. The lower housing section is formed to define a generally cylindrical internal wall structure 80 defining a passage through which the operator mandrel 38 is allowed to pass. The lower portion of the lower housing section 78 is formed to define an internally threaded section 82 that is adapted to receive the upper externally threaded portion 84 of a lower connector sub 86. The connector sub 86 is formed to define an internally threaded lower portion 88 that is adapted for threaded connection to the upper extremity of the fishing tool 20 in the manner illustrated in FIG. 1.

Intermediate the extremities of the operator mandrel are provided a pair of opposed striker elements 90 and 92 which are illustrated in greater detail in the transverse sectional view of FIG. 5. The striker elements 90 and 92 are formed integrally with the operator mandrel 38 and define upwardly directed striker shoulders 94 and 96 that are adapted for striking engagement with downwardly directed lower shoulders 98 and 100 that are defined respectively by the opposed anvil structures 58 and 60. Upon sufficient upward movement of the operator mandrel within the housing structure, the shoulders 94 and 96 of the striker elements 90 and 92 will strike the opposed shoulders 98 and 100 of the anvil elements, thereby imparting an impact force to the anvil structures and thus to the housing. This force is transmitted through the housing to the fishing tool 20 and through the fishing tool to the fish thereby jarring the fish and tending to loosen it from its struck condition within the well bore or casing.

It is desirable to impart a controlled force to the fish during jarring operations and to impart the controlled force in repetitive manner to thus ensure that the fish is properly loosened from its struck condition without causing structure damage to the fishing jar mechanism, the fishing tool or the stuck object. In accordance with the present invention, one suitable means for accomplishing controlled application of jarring forces to the fishing tool and fish may be conveniently accomplished by controlling the upwardly directed impact force in accordance with a controllable operator release mechanism. As shown particularly in FIG. 3a, the cylindrical portion of the operator mandrel 38 cooperates with the internal wall surface 102 of the upper housing section 24 to define a spring chamber 104 within which is positioned a compression spring 106. The lower portion of the compression spring 106 is seated against the generally cylindrical upper extremity of a spring load transmitting element 108 that defines lower shoulder surfaces 110 and 112 that are adapted for engagement with upper shoulder surfaces 114 and 116 that are defined by the anvil structures 58 and 60. The load prong elements 70 and 72 are formed integrally with the cylindrical upper portion of the spring load transmitting element 108. With reference particularly to FIG. 5, the load prong elements 70 and 72 are of arcuate configuration and extend through opposed arcuate grooves 118 and 120 that are defined by the relationship of the striker elements 90 and 92 with the cylindrical portion of the operator mandrel 38. The load prong elements are therefore adapted to extend from a position above the anvil structures 58 and 60 to a position below the striker elements 90 and 92.

The lower extremities of the load prong elements 70 and 72 are adapted to engage the upper extremity of an elongated latch element 122 that is movably positioned within the lower housing section 78. The latch element, which is also referred to as a ball race structure, is formed to define a reduced diameter lower portion 124 that is received within a passage or bore 126 defined in the lower connector sub 86. The reduced diameter portion of the latch element cooperates with the wall structure of the lower housing section to define a latch spring chamber 128 within which is contained a compression spring 130 having its lower extremity in engagement with a stop shoulder 132 defined by the connector sub. The upper extremity of the latch spring 130 bears against an annular shoulder 134 of the latch element and functions to urge the latch element upwardly within the lower housing structure. The lower housing section is formed internally to define upper and lower annular detent grooves 136 and 138 that are separated by an annular detent positioning surface 140. The upper portion of the latch element 122 is formed to define a plurality of detent receptacles 142 that are adapted to receive a plurality of spherical detent elements 144 that are of greater diameter than the wall thickness of the latch element and thus are enabled to protrude beyond the inner or outer wall surfaces of the latch element.

The lower portion of the operator mandrel is formed to define an annular detent groove 146 that is adapted to receive the detent elements 144 in the manner illustrated in FIGS. **3*b* and 4, thus securing the latch element 122 in structurally interconnected assembly with the lower portion of the operator mandrel. The lower portion of the operator mandrel is formed to define an annular curved cam surface 148 that provides a camming activity during resetting of the fishing jar mechanism that urges the spherical detents 144 radially outwardly into the lower detent groove 138** of the housing structure. This feature will be described in detail in connection with operational movement of the internal parts of the fishing jar mechanism.

The latch element 122 is enlarged within the upper portion thereof to define a receptacle 150 for the lower extremity of the operator mandrel and is also formed internally to define a flow passage or bore 152 at the lower portion thereof through which circulating fluid passes from the operator passage 50. The lower connector sub 86 is formed internally to define a flow passage 154 for passage of the circulating fluid and defines an internal shoulder 156 against which is seated a hardened annular bumper element 158 that may be struck repeatedly by the lower extremity 160 of the latch element 122 without resulting in any degree of structural deformation. The bumper ring element 158 is replaceable in the event structural deformation should occur.

Figure 2:
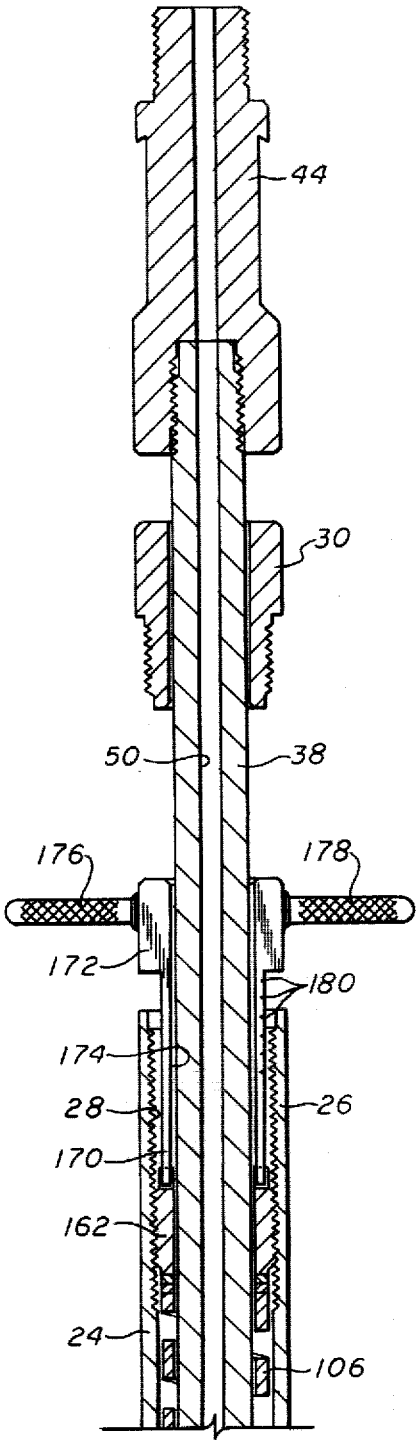

In order to preset the compression spring 106 to deliver a desired force through the load prongs to the latch elements 122, an adjustment nut 162 is threadedly received by the internal elongated threads 28 of the upper housing section. The lower extremity of the adjustment nut 162 bears against a soft metal bearing element 164 such as might be composed of bronze with the bearing element seated against a metal seat ring 166 that in turn is seated against the upper extremity of the compression spring. Upon rotation of the adjustment nut 62, the compression spring 106 is either compressed or allowed to extend, and thus establish the spring force that is transmitted to the spring load transmitting element 108 and through the load prongs to the latch element 122. The upper extremity of the adjustment nut 162 is formed to define a tool receptacle 168 that is engaged by a nut positioning portion 170 of a spring adjustment tool 172. With the upper end cap 30 unthreaded from the upper extremity of the housing in the manner illustrated in FIG. 2, the adjustment tool, which defines a semicylindrical groove 174 adapted to receive the cylindrical portion of the operator mandrel, may be introduced into the open upper extremity of the housing section for engagement with the upper portions 168 of the adjustment nut 162. With adjusting engagement thus made, the personnel in charge will merely rotate the adjustment tool 172 by means of the handles 176 and 178 thereof, causing threading or unthreading of the adjustment nut 162 as desired to properly establish proper compression of the spring 106.

The tool is formed to define a plurality of adjustment indicator marks or grooves that may be selectively brought into registry with the upper extremity of the upper housing section to thus provide a visual indication of the degree of compression of the spring 106 that is established by positioning of the spring adjustment nut 162. For example, with the spring adjustment nut 162 positioned in barely touching engagement with the compression spring, movement of the latch element 122 to the release position against the compression of the spring will induce a particular impact force, such as 300 lbs., for example, against the anvil structures. The adjustment nut 162 may be threaded inwardly sufficient to increase the striking force of the striker elements against the anvil structures to approximately 1,000 lbs. Of course, the impact force induced by the compression spring 106 will be determined by the nature of the compression spring and by the length of compression stroke that is induced to the spring.

While the jar structure illustrated in FIGS. **3*a* and 3*b* is appropriate for operations where it is run into the well by tubing so that fluid circulation may be conducted through the jar mechanism, it is not necessary to accommodate volumetric interchange within the jar mechanism because of the open bore. In circumstances where the jar mechanism is employed in the wire-line mode, it is necessary to provide communication between the internal portion of the jar mechanism and the external environment as shown in FIG. 3*c*, the lower sub 86*a* is formed to define vent passages 87 and 89** that allow fluid interchange with the external environment and thus prevents hydraulic interference with operation of the jar mechanism.

OPERATION

Referring now to FIGS. *7a, 7b* and *7c,* various operational movements of the internal structural components of the fishing jar mechanism are illustrated. With reference to FIG. *7a,* the latch element 122 and the operator mandrel 138 are in the neutral position with the ball detents 144 being maintained intermediate the upper and lower detent grooves 136 and 138 of the housing. The detent positioning surface 140 effectively maintains the detents in engagement within the annular detent groove 146 of the operator mandrel. Thus, the latch structure 122 and the operator mandrel 38 are locked in assembly by means of the detents 144. A jarring operation is initiated by imparting an upward force to the wire line or tubing that supports the fishing mechanism within the well, thus taking up all of the cable or tubing stretch. After this has been accomplished, further upward movement of the surface control equipment causes an upward force to be applied to the operator mandrel 38, tending to move it upwardly. Due to the interlocked relation between the operator mandrel and the latch structure 122, the latch also is moved upwardly until such time as the detents 144 move outwardly into the detent groove 136 in the manner illustrated in FIG. *7c.* During such upward movement of the operator mandrel, the latch structure 122, bearing against the lower portions of the load prong elements 70 and 72, induce application of an upwardly directed force to the lower extremity of the compression spring 106. The amount of upward force that is required for movement of the operator mandrel and latch elements from the neutral position illustrated in FIG. *7a* to the release position illustrated in FIG. *6c* is dependent upon the degree of compression of the spring 106. With the spring adjustment nut loosely set, the release force will be in the order of 300 lbs. or, depending upon the position of the adjustment nut, between 300 lbs. and 1,000 lbs.

Upon outward movement of the detents 144 into the upper detent groove 136 of the housing, the operator mandrel 38 will be released from its connection with the latch element 122 and will then move upwardly in accordance with the particular release force that has been reached. The striker elements 90 and 92 of the operator mandrel 38 will thus be caused to move upwardly and strike the anvil elements 58 and 60 with an impact that is controlled by the detent release force, thus imparting an upwardly directed jarring force through the housing structure and fishing tool to the fish connected at the lower extremity thereof.

Upon release of the structural interconnection between the operator mandrel and the latch element 122, the latch element will be forced downwardly by the load prongs 70 and 72 under compression of the spring 106 such as shown in FIG. *7b.* At this point, the detent elements 144 may move partially into the lower detent groove 138 but will immediately be moved radially inwardly as the latch spring 130 urges the latch element upwardly to the neutral position thereof as illustrated in FIG. *7a.* At this point, the lower extremity 148 of the operator mandrel 38 will be positioned well above the upper detent groove.

The operating personnel in charge of the jarring operation may then accomplish controlled downward jarring by allowing the supporting tubing to move downwardly under control of the brake mechanism of the drilling rig. A first increment of downward movement must be accomplished before jarring to accommodate the stretch in the pipe or cable. For example, it is not unusual for the combined stretch of a string of tubing in a deep well to be in the order of 36 inches. The driller simply lowers the tubing that required interval to accommodate pipe stretch and then, watching the weight indicator of the rig, stops downward movement when the appropriate weight is indicated. The result is a sharp downward force that, together with the upward jarring force, is quite reliable in loosening stuck objects. Quite logically, a hydraulic jar mechanism would burst from excessive hydraulic pressure if the supporting tubing or pipe would be suddenly dropped in the manner described above.

In the event no downward jarring force is desired, the operator simply lowers the pipe or wire-line slowly to reset the jar mechanism and then moves the pipe or wire-line upwardly to actuate the jar mechanism and deliver a controlled jarring force to the fish.

In order to accomplish resetting of the interlocked relationship between the latch element and the operator mandrel, the operator mandrel is then moved downwardly, causing the annular cam portion 148 thereof to engage the inner portions of the respective detents. When this occurs, the latch element 122 will be moved downwardly against the compression of the latch spring 130 until the detents become registered with the detent groove 138. When this occurs, the cam portion 148 of the operator mandrel will force the detent elements 144 radially outwardly into the lower detent groove. This allows the lower portion of the operator mandrel to move downwardly sufficiently to bring the detent groove 146 thereof into registry with the detents. As the operator mandrel is then moved upwardly, the latch spring 130 causes the latch structure 122 to follow this upward movement which allows the detents to be cammed into the detent groove 146. Interlocked assembly between the latch element and operator mandrel will then be maintained by surface 140 with the parts at the neutral position thereof.

Personnel in charge of fishing operations will simply attach the fishing jar mechanism to either a tubing string or appropriate wire line control equipment with a fishing tool attached at the lower extremity thereof. Prior to introduction of the fishing jar mechanism into the well bore, personnel will appropriately set the adjustment nut 162 thereof in order to provide a particularly designed impact force resulting from the degree of compression of the spring 106. The apparatus will then be lowered into the well bore, brought into appropriate gripping contact with the fish and thereafter operating personnel will merely impart upward and downward movement sufficiently to cause actuation of the fishing jar mechanism. During each upward stroke, a particularly designed impact force will be transmitted from the fishing jar mechanism to the fish for the purpose of loosening its stuck relationship within the well bore. In the event a greater jarring force is desired, the operating personnel will withdraw the fishing jar mechanism from the well, unthread the upper end cap 30 from the housing structure 24 and will then introduce the adjustment tool 172 in the manner illustrated in FIG. 2, to thus position the adjustment nut 162 appropriately to establish desired compression of the spring 106 and thus desired detent release in the manner described above. The fishing jar mechanism does not incorporate any internal O-rings, such as are typically found in similar well service tools, thus eliminating any internal friction from interfering with controlled application of impact forces to the fish. Moreover, the fishing jar mechanism may be immersed and completely filled with circulation fluid without any detriment to operational activity thereof. After use, the fishing jar mechanism may simply be flushed out with water to prevent any well cement therein from setting up and may also be flushed with oil to prevent corrosion of the internal parts.

While the downhole jar mechanism illustrated in FIGS. 1–7*c* functions under circumstances where well fluid enters the jar mechanism, it is intended that the jar mechanism remain in the well for limited periods of time so that the internal parts thereof are subjected to a corrosive medium for limited periods of time. Typically, the internal parts of the jar mechanism of FIGS. 1–7*c* will be provided with a coating of protective oil, that will prevent corrosion of the internal parts for a limited period of time, for example, up to a few days time. Further, it is not intended that the jar mechanism of FIGS. 1–7*c* be utilized under circumstances where an abrasive medium such as drilling fluid is circulated through the jar mechanism. Typically, the jar mechanism is utilized under circumstances where the medium circulated through the jar mechanism is of noncorrosive or abrasive nature, such as circulating fluid for well completion or well servicing activities. The jar mechanism of FIGS. 1–7*c* will be of typically sufficiently small diameter to be run through the production tubing of a deep well, for the purpose of retrieving downhole tools and other objects. In the event a rotational function is desired, such as reaming, the jar mechanism may be utilized effectively since the relationship of the load prong structure to the jar body defines a nonrotatable relationship. If desired, torque can be applied through the jar mechanism for the purpose of assisting in release of a fish from its stuck condition within the well, with jarring activities being accomplished in conjunction with application of torque.

Under circumstances where a downhole jar mechanism is to be utilized in conjunction with drilling operations and where it is intended that the jar mechanism remain in the downhole environment for extended periods of time, for example during drilling, it is desirable to provide a jar mechanism that is efficiently protected against contamination of the internal moving parts thereof by the well fluid environment within which it is immersed. For example, drilling fluid, cement slurry, etc. may be circulated through the jar mechanism and therefore it is intended that the internal parts of the jar mechanism be efficiently protected against contamination by these mediums.

An internally protected downhole jar mechanism according to the present invention may conveniently take the form illustrated in FIGS. 8*a*–12. FIGS. 8*a* and 8*b* illustrate upper and lower portions of the internally protected jar mechanism. As shown in FIG. 8*a*, the jar mechanism, illustrated generally at 200, incorporates an upper mandrel sub 202 having an internally threaded box portion 204 that is adapted to receive the externally threaded lower pin portion of any suitable connection and support device such as a string of drill pipe, a wire line tool, etc. The upper mandrel sub 202 is formed to define a reduced diameter elongated portion 206 defining an upper smooth cylindrical sealing surface 208 and an intermediate portion 210 that is machined so as to define an elongated male spline portion 212 that is adapted to be received within an internal splined section 214 of an anvil body 216 that is disposed in movable relation about the mandrel sub. The mandrel sub is also formed to define a central flow passage 218 through which fluid is allowed to flow for purposes of circulation within the well bore. For example, drilling fluid, cement slurry and various other fluid mediums for drilling and completion of the well may be pumped through the flow passage 218. At the lower portion of the upper mandrel sub is provided upper and lower externally threaded portions of differing diameter as shown at 220 and 222, respectively. The upper external thread 220 is adapted to receive an internally threaded anvil structure 224 having an annular head portion 226 defining a shoulder 228 that engages a shoulder 230 defined at the lower portion of the upper threaded section. The anvil structure 224 defines an upper striker shoulder 232 that is adapted for striking engagement with a lower shoulder structure 234 defined at the lower portion of the anvil body.

The anvil body of the downhole jar mechanism is defined by the upper anvil body section 216 having an externally threaded lower portion 236 that is adapted to receive the internally threaded upper portion 238 of a lower anvil body or housing structue 240. Sealing elements 242 and 244 such as O-rings or the like are received within seal grooves defined at the upper and lower extremities of the externally threaded portion 236 of the upper anvil body section 216. These sealing elements establish positive seals against internal annular surfaces of the lower anvil body housing 240, thus positively sealing the housing structure of the jar mechanism against contamination by the external fluid medium within which the jar mechanism is located.

The external body structure of the jar mechanism is also formed in part by a spring housing structure 246 having an internally threaded upper extremity 248 that is received in threaded engagement with an externally threaded lower portion 250 of the lower anvil body 240. The sealed integrity of the body structure is further maintained by an annular sealing element 252 which establishes a positive seal at the threaded interconnection between the lower anvil body housing 240 and the spring housing 246.

The elongated flow passage extending through the jar mechanism is also defined in part by an internal elongated passage 254 that is defined by a lower internal tubular mandrel 256 that also cooperates with the spring housing 246 to define an internal annular spring chamber 258 within which is located a compression spring assembly 260 that is composed of a plurality of belleville type springs that function under compression to store controlled energy for the jarring impact force that occurs when the jar mechanism is activated. The lower extremity of the compression spring assembly 260 bears against an upwardly directed annular shoulder surface 262 defined by a load ring 264. The lower shoulder surface 266 of the load ring is adapted to bear against an internal annular shoulder surface 268 defined internally of the spring housing 246, thus providing a movable stop for the lower extremity of the compression spring assembly.

As mentioned above, the compression spring assembly may be appropriately adjusted to provide jarring forces of controlled magnitude. Of course, the compressive magnitude of the compression spring assembly will determine the range of spring force that is transmitted upon actuation of the jar mechanism. For example, the compression spring assembly 260 may be designed to deliver a minimum of 10,000 pounds force with minimum spring compression and when compressed to the maximum extent thereof, may be designed to deliver a compressive force in the order of 25,000 pounds. At the 10,000 pound spring force setting, an impact load in the order of 42,000 pounds will be developed and the apparatus will have a safe straight pull working load in the order of 198,800 pounds. With the compression spring assembly adjusted to the 25,000 pound setting thereof, an impact force of 105,000 pounds is delivered by the spring assembly upon actuation of the jar mechanism.

In order to provide for adjustment of the compression of the spring assembly 260, an adjustment element 270 is provided, having an externally threaded upper portion 272 that is received by the lower portion of the internal threads 248 of the spring housing. A lower abutment shoulder 274 of the adjustment element 270 bears against the upper race of a load adjustment bearing mechanism 276 that is interposed between the adjustment element and the upper extremity of the compression spring assembly. Upon rotation of the adjustment element 270, the adjustment element will be moved linearly by virtue of its threaded connection with the internal threads of the spring housing. During rotation of the adjustment element, the load adjustment bearing assembly 276 will prevent the introduction of any torque to the compression spring assembly.

To accomplish adjustment or rotation of the adjustment element 270, the adjustment element is formed to define an externally splined and grooved portion 278 about the periphery thereof. These splines and grooves define external teeth that may be engaged by an adjustment tool such as a screwdriver, for example, that is inserted through an aperture 280 formed in the wall structure of the spring housing. The aperture 280 is internally threaded and is adapted to receive a closure plug 282 that may be inserted and removed by means of an Allen wrench or any other suitable tool. Since there is a possibility that high fluid pressure at the bottom of a well bore might cause leakage at the plug 282, a pair of external seals 284 and 286 are provided on the outer periphery of the adjustment element and establish sealing engagement with the inner surface of the spring housing 246. Through employment of a compression spring assembly as shown, having a compressive range between 10,000 and 25,000 pounds, each ¼ inch of linear movement of the adjustment element will increase the spring force by a magnitude of 5,000 pounds. It is only necessary therefore to provide a linear adjustment range of 1 inch for the adjustment element 270 in order to modify the compressive range of the jar mechanism from 10,000 pounds to 25,000 pounds.

It is desirable to provide a mechanism for allowing storage of the spring force by relative movement of the housing sections and to release the spring upon a development of a predetermined force. This feature is effectively accomplished as shown in the intermediate portion of FIG. **8*b* where the spring housing of the jar mechanism and the lower portion of the internal mandrel cooperate to define a release and reload latching section of the jar mechanism. The housing structure 246 is formed internally to define a pair of annular spaced segment release grooves 288 and 290 that are adapted to receive a plurality of latching segment elements 292 upon registry of the segment elements with respective ones of the grooves. In comparitive manner, the latching detent segments 292 perform the same function as the ball detent element 144 of the embodiment illustrated in FIGS. 1–7*c*. Within an annular space defined between the housing 246 and the inner mandrel 256, a segment detent race 294 is provided, having a plurality of detent apertures 296 defined therein and adapted to receive the plurality of detent segments 292. A return spring chamber 298 is also defined between the housing 246 and the mandrel 256 and a return spring 300 is disposed within the spring chamber and bears against the lower extremity of the segment detent race 294. The return or reload race spring 300 urges the race 294 into engagement with the inner peripheral portion of the annular surface 266 of the load ring 264. The inner mandrel is formed to define an annular detent groove 302 that is adapted to receive inner portions of the detents 292 in the position shown in FIGS. 8*b* and 12, which is the centered or neutral position of the reload race 294 and the detents 292**.

The lower portion of the jar mechanism is defined by a bottom sub 304 having an upper externally threaded portion 306 that is received by an internally threaded portion 308 defined at the lower extremity of the housing 246. The bottom sub is sealed with respect to the housing 246 by means of a pair of O-rings or other suitable sealing element 310 and 312 that are positioned on either side of the interconnecting threads 306 and 308. The bottom sub 304 is also formed to define an internal receptacle 314 within which is received the lower extremity 316 of the tubular mandrel 256, thus allowing linear movement of the internal mandrel relative to the outer housing structure of the jar mechanism. The lower extremity of the bottom sub 304 is formed to define an externally threaded pin connection 318, that allows the jar mechanism to be suitably interconnected with a typical drill collar, a fishing tool or any other suitable internally threaded structure. The bottom sub is also formed to define an internal passage 320 that allows flow of circulating fluid medium from the jar mechanism downwardly into any structure interconnected therewith.

Operation of the latch and release mechanism to cause actuation or firing of the jar mechanism is accomplished in the following manner: With the jar mechanism in connection with a fishing tool or simply in connection with sections of drill pipe above a typical drill bit, jarring activity is accomplished when the driller or operator of the drilling rig moves the drill string upwardly. A first increment of this upward movement of the drill string simply functions to stretch the pipe or wireline and thereafter, further upward movement moves the mandrel sub and the inner mandrel of the jar mechanism upwardly while the outer housing structure thereof remains in static position by virtue of its interconnection with the stuck object. As upward force is applied, the latched interconnection between the inner mandrel, the plurality of latching release and reload segments 292 and the reload race 294 cause a mechanical force to be applied to the load ring 264 thereby applying compression to the compression spring assembly 260. Upon reaching the maximum compression allowed by the position of the spring adjustment element 270, the detents 292 will have been moved upwardly bringing them in registry with the release groove 288, such movement of the detents being accomplished by movement of the inner mandrel against the compression of the spring assembly 260. As soon as the segment detents are capable of movement into the release groove 288, appropriate cam surfaces defined within the mandrel groove 302 causes outward camming of the segments into the release groove 288. Upon this occurrence, the anvil 224, by virtue of its threaded interconnection with the upper mandrel, will move upwardly while maintaining its continuous engagement with the upper extremity 257 of the lower mandrel 256. When the latching segments 292 shift outwardly into the segment release groove 288, the lower mandrel 256 and thus also the upper mandrel 202 will be released and, with the preset release force being applied to the upper mandrel sub 202 by the wire line or pipe string, the striker shoulder 232 of the anvil 224 will then be moved into striking engagement with the lower surface 234 of the anvil body 216. This causes a controlled jarring force to be then transmitted from the anvil body downwardly through the outer housing structure defined by housing sections 240 and 246 to the bottom connector sub 304. The bottom connector sub then transmits this controlled upwardly directed jarring force into the drill pipe, fishing tool or other structure to which it is connected by means of the pin structure.

Simultaneously with release of the lower mandrel 256 by outward movement of the latching segments 292, and after sufficient upward movement of the internal mandrel to clear the tapered shoulder 303, the load ring 264 will be shifted downwardly by the compression of the spring assembly 260 and will thence cause downward recentering movement of the detent race 294. This downward movement of the detent race will cause camming of the detent segments radially inwardly into the detent apertures 296 thereby allowing the detent race 294 to be shifted back to the centralized or neutral position thereof as shown in FIG. 12. After the inner mandrel has been released and has moved upwardly to induce the upwardly directed jarring force, it is then free for downward movement and this downward movement may occur as rapidly as is desired. To accomplish downward jarring, the driller will simply lower the drill string downwardly sufficiently to accommodate all of the pipe stretch and will then apply a downward jarring force simply by stopping downward movement when the weight indicator reaches the appropriate magnitude. Unlike hydraulic jar mechanisms which cannot be lowered rapidly, the jarring mechanism of this invention may be lowered as rapidly as possible without regard to any damage to the jar mechanism. The operator of the drilling rig is therefore enabled to impart controlled upward and downward jarring forces to the fish, thereby facilitating efficient release of the fish from its stuck condition within the well.

After upward jarring has occurred, the jar mechanism is reset simply by downward movement of the inner mandrel. This downward movement causes shoulder 303 to contact the segments and shift them downwardly from the centered position of FIGS. **8*b* and 12. Upon reaching the segment relatching groove 290, the segments will be shifted radially outwardly by the camming action of the tapered shoulder 303 into the groove 290. This then allows further downward movement of the inner mandrel sufficiently to bring the latching groove 302 into registry with the groove 290. By virtue of the force induced by the reload race spring 300, the segments will be cammed into the latching groove 302. Thereafter, the race 294** will be structurally interconnected by the detents to the inner mandrel and the segments and race will shift to the neutral position upon neutralization of jar operating forces.

The jar mechanism of the present invention may be rotated as desired because the splined connection defined by external splines 212 and internal splines 214 provide for transmission of torque between the inner mandrel and outer housing structures of the jar mechanism. The ability to apply torque through the jar mechanism facilitates drilling operations with the jar interconnected with the drill string and also facilitates release of stuck objects within the well bore through combination activities including controlled upward jarring, controlled downward jarring and controlled application of torque.

As mentioned above, it is desirable to provide protection of the internal parts of the jar mechanism against the corrosive and erosive effects of the downhole fluid medium under circumstances where the jar mechanism is to remain immersed in the well fluids for extended periods of time. In accordance with this invention, the internal movable components of the jar mechanism may be efficiently protected against corrosion and erosion by a protective fluid medium without in any way altering the operational aspects of the invention from the standpoint of hydraulic pressures that might interfere with operation. The structural interrelationship of the inner mandrel structure and the outer housing structure of the jar mechanism, develops an elongated protective chamber that extends virtually the entire length of the jar mechanism. This chamber is developed by the annulus or annular space between the inner mandrel and outer housing structures. A pair of sealing elements 322 and 324 are retained within annular seal grooves defined within the upper portion of the anvil body 216 and function to establish fluid-tight seals with the cylindrical outer surface 208 of the inner mandrel. The protective chamber 326 is thus provided within an upper seal defined by sealing elements 322 and 324. As the inner mandrel moves relative to the outer housing structure, there is volumetric change within the protective chamber 326 and this volumetric change is accommodated by means of an annular pressure balancing piston element 328 having a pair of internal annular seals 330 that seal against a cylindrical surface 332 of the mandrel and a pair of outer annular seals 334 that establish seals with an inner cylindrical surface 336 of the housing structure. As volumetic changes occur within the annulus between the mandrel and housing, the piston element 326 moves linearly within the annular spring chamber 338, thus accommodating the volumetric change that has occurred. Likewise, as relative movement occurs between the mandrel and housing in the opposite direction, the piston element 328 shifts in the opposite direction to accommodate the volumetric change that has occurred. The piston 328, being a free piston, maintains a balanced pressure condition between the protective fluid medium such as silicone oil within the protective chamber and the pressure of the fluid medium within the flow passage that extends through the jar mechanism. The axial length of the piston chamber 338 is sufficient to accommodate any piston movement that might occur. Since the pressure across the piston 328 is balanced, and volumetric change of the protective chamber is allowed to occur freely without pressure interference, the downhole jar mechanism may be lowered as rapidly as possible to induce downwardly directed jarring without any possibility of hydraulic damage to the jar mechanism.

In view of the foregoing, it is therefore apparent that the present invention is one well adapted to attain all of the features hereinabove set forth together with other advantages which will become obvious and inherent from a description of the apparatus itself. It will be understood that certain combinations and subcombinations are of utility and may be employed without reference to other features and subcombinations. This is contemplated by and is within the cope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

What is claimed is:

1. A downhole jar mechanism for freeing stuck objects within a well bore, said jar mechanism comprising:

a body structure including an anvil structure adapted for disposition in force transmitting relation with downhole fishing apparatus that establishes interconnection with an object stuck within said well bore;

an operator element receivable in movable relationship within said body structure including striker means axially immovably connected thereto adapted to strike said anvil and impart an upwardly directed impact force thereto;

compression spring means adapted to oppose movement of said striker means toward said anvil means; and, means for releasing said striker means from the opposing force of said compression spring upon predetermined upward movement of said striker means toward said anvil structure, thereby controlling the force of impact of said striker means against said anvil structure, said releasing means including;

first detent recess means being defined internally of said body structure, latch means disposed between said body structure and said operator element, said latch means being formed to define detent aperture means, said operator element being formed to define second detent recess means, detent means maintained within said detent aperture means and said second detent recess means by said body structure and interlocking said latch means and said operator element in said releasable interconnection, and spring-energizing means being interposed between said latch means and said compression spring means and transmitting upward movement of said latch means to said spring means for compression of said spring means.

2. A downhole jar mechanism as recited in claim 1, wherein:

said second detent recess means defines cam means urging said detent means into said first detent recess means upon said predetermined upward movement of said operator element, releasing said interconnection between said latch means and said operator element and allowing upward movement of said striker element against said anvil structure.

3. A downhole jar mechanism as recited in claim 1, wherein:

said first detent recess means is an annular internal groove defined within said body structure;

said detent aperture means are a plurality of apertures formed in said latch means;

said detent means comprise a plurality of ball detents received by respective ones of said plurality of apertures; and said second detent recess means comprises an annular external groove defined by said operator means.

4. A downhole jar mechanism as recited in claim 1, wherein said first detent recess means comprises:

an upper annular internal detent groove being defined by said body structure and adapted to receive said detent means during release of said operator means from said latch means;

a lower annular internal detent groove being defined by said body below said upper annular internal detent groove and adapted to receive said detent means during resetting of said releasable interconnection between said latch means and said operator means upon downward resetting movement of said operator means.

5. A downhole jar mechanism as recited in claim 1, including:

latch spring means interposed between said latch means and said body structure, said latch spring means imparting an upwardly directed spring force to said latch element.

6. A downhole jar mechanism as recited in claim 1, wherein:

the lower extremity of said operator means is formed to define detent cam means, said detent cam means urging said detent means toward said first detent recess means during downward resetting movement of said operator means within said body structure.

7. The downhole jar mechanism as recited in claim 1, including:

means for selectively adjusting said predetermined compression of said spring and thereby selecting the impact force delivered by said striker means against said anvil structure and thus the jarring force transmitted through said body structure to said stuck object.

8. A downhole jar mechanism as recited in claim 7, wherein:

said body structure is formed to define internal spring adjustment thread means;

spring adjustment means being threadedly received by said spring adjustment thread means and being in engagement with said spring means, said spring adjustment means being selectively positionable within said body structure to selectively control the compressive force of said spring upon release of said latch means from said operator means.

9. A downhole jar mechanism for applying upwardly-directed impact forces to objects within a well bore, said jar mechanism comprising:

an elongated housing structure adapted for connection of the lower extremity thereof to a fishing tool to be positioned in engagement with an object within said well bore, said body structure being formed to define internal anvil means and internal body recess means;

an elongated operator mandrel being receivable in movable relation within said housing struture and having connection means at the upper extremity thereof for connection with tool-supporting means, said operator mandrel having limited upward movement relative to said body structure and being formed to define operator recess means;

operator latch means being movably received within said body structure and adapted to establish a releasable interconnection between said operator mandrel and said body structure, said operator latch means releasing the connection thereof with said operator mandrel upon predetermined upward movement of said operator mandrel within said body structure, said operator latch means including, an elongated latch element being movably positioned within said housing structure and adapted for interfitting relation with said operator mandrel, detent means for interlocking said operator mandrel and latch element in releasably interlocked force transmitting assembly, means for releasing said detent means from said interlocking relation with said operator mandrel and latch element, and means transmitting the spring force of said compression spring to said latch element;

striker means being defined on said operator mandrel and being positioned to engage said anvil means at the upper limit of operator mandrel movement relative to said body structure; and a compression spring being positioned within said body structure, said compression spring being compressed during predetermined upward movement of said operator mandrel, thus applying opposing spring force opposing said predetermined upward movement of said operator mandrel, said operator latch means releasing said spring force from said operator mandrel responsive to said predetermined upward movement of said operator mandrel and freeing said operator mandrel for movement of said striker means into striking engagement with said anvil means.

10. A downhole jar mechanism as recited in claim 9, wherein:

said striker means is formed integrally with said operator mandrel; and said anvil being formed integrally with said body structure.

11. A downhole jar mechanism as recited in claim 9, wherein:

said latch means is of at least partially tubular form and is adapted for telescoping interengagement with said operator mandrel;

said mandrel is formed to define first detent receiver means;

said latch element is formed to define detent receptacle means, said detent means being receivable within said detent receptacle means and being engageable within said detent receiver means in said releasably interlocked relation of said operator mandrel and latch element.

12. A downhole jar mechanism as recited in claim 11, wherein:

said housing structure is formed internally to define second detent receiver means, said detent means being movable into said second detent receiver means upon registry of said detent receptacle means and becoming separated from said first detent receiver means for release of said interlocked relation between said operator mandrel and latch element, whereby said operator mandrel is movable within said housing structure independently of said latch element.

13. A downhole jar mechanism as recited in claim 9, wherein said means transmitting the spring force of said compression spring to said latch element comprises:

a spring load transmitting element being movably positioned within said housing structure, said compression spring bearing on said spring load transmitting element and urging said spring load transmitting element in a direction toward said latch element; and load prong means extending from said spring load transmitting element and establishing force transmitting relation with said latch element.

14. A downhole jar mechanism as recited in claim 13, wherein:

said anvil means is an internal anvil shoulder structure defined by said housing structure, said anvil means cooperating with said housing structure to define first force-transmitting passage means;

said striker means being external striker structural shoulder means defined by said operator mandrel and adapted for striking force-transmitting relation with said internal anvil shoulder structure, said striker means cooperating with said housing means to define second force-transmitting passage means registering with said first force-transmitting passage means; and said load prong means extending through said first and second force-transmitting passage means.

15. A downhole jar mechanism as recited in claim 14, wherein:

said first and second passage means are defined by opposed pairs of recesses defined respectively by said anvil means and said striker means; and said load prong means comprise a pair of opposed elongated structural elements extending from said spring load-transmitting element through said first and second passage means and having force-transmitting contact with said latch element.

16. A downhole jar mechanism as recited in claim 11, wherein:

said housing structure is formed to define upper and lower spaced internal detent grooves separated by a detent positioning surface, said detent positioning surface maintaining said detent means in the latched position thereof, locking said latch element and operator mandrel in said interlocked force-transmitting section, upon movement of said detent means into registry with said upper detent groove, said detent means being moved into said upper detent groove and disengaging from said detent receiver means.

17. A downhole jar mechanism as recited in claim 16, wherein:

said operator mandrel is formed to define detent cam means, said detent cam means imparting camming movement of said detent means into said lower detent groove during resetting movement of said operator and positioning said detent means for entry into said detent receiver means.

18. A downhole jar mechanism as recited in claim 16, wherein:

said detent means are spherical detents.

19. A downhole jar mechanism for applying upwardly and downwardly directed impact forces to objects within a well bore, said fishing jar mechanism comprising:

an elongated housing structure adapted for connection of the lower extremity thereof to a fishing tool to be positioned in engagement with an object within said well bore, said body structure being formed to define internal anvil means and internal body recess means;

anvil body means being provided on said housing structure and defining impact receiving means;

an elongated operator mandrel being receivable in movable relation within said housing structure and having connection means at the upper extremity thereof for connection with tool-supporting means, said operator mandrel having limited upward movement relative to said body structure and being formed to define operator recess means, said housing structure and said operator mandrel cooperating to define a protective chamber therebetween, said protective chamber adapted to be filled with a protective fluid medium;

anvil means being provided on said operator mandrel and defining striker means;

operator latch means being movably received within said protective chamber and adapted to establish a releasable interconnection between said operator mandrel and said body structure, said operator latch means releasing the connection thereof with said operator mandrel upon predetermined upward movement of said operator mandrel within said body structure;

compression spring means being positioned within said protective chamber, said compression spring means being compressed during predetermined upward movement of said operator mandrel, thus applying opposing spring force opposing said predetermined upward movement of said operator mandrel, said operator release element releasing said spring force from said operator mandrel responsive to said predetermined upward movement of said operator mandrel and freeing said operator mandrel for movement of said striker means into striking engagement with said impact-receiving means, thus causing striking impact with the impact force thereof being controlled by a latch releasing force controlled by the compression of said spring means; and pressure balancing and volume compensating means defining sealed closure means for said protective chamber.

20. A downhole jar mechanism as recited in claim 19, wherein said operator latch means comprises:

latch release groove means being defined within said housing;

detent unlatching groove means being defined by said operator mandrel;

a plurality of arcuate segment detent elements being receivable by said detent groove means to establish force-transmitting relation from said operator mandrel to said compression spring means upon upward movement of said operator mandrel, said segment detent elements being moved into said detent unlatching groove means upon predetermined upward movement of said operator mandrel relative to said housing means, thereby releasing said operator mandrel from the compression of said spring means upon application of predetermined upward force against said compression spring and causing said anvil means to strike said anvil body means and develop an impact force thereagainst which is controlled by the compression of said spring at said releasing of said operator mandrel.

21. A downhole jar mechanism as recited in claim 19, wherein said mechanism includes:

spring adjustment means for adjusting the compression of said compression spring means, thereby causing selective variation of the opposing spring force at releasing of said operator mandrel and thus causing selective variation of the upward impact force transmitted from said operator mandrel to said housing structure.

22. A downhole jar mechanism as recited in claim 19, wherein said spring adjustment means comprises:

an adjustment element having threaded interconnection with said housing structure and supporting one extremity of said compression spring means, said adjustment element moving linearly upon rotation thereof relative to said housing structure and selectively changing the compression of said compression spring means, said adjustment element being formed to define external adjustment teeth thereon;

an adjustment aperture being formed in said housing structure and allowing access to said adjustment teeth, whereby an adjustment tool may be inserted through said adjustment aperture into operative engagement with said adjustment teeth; and removable closure means for said adjustment aperture.

23. A downhole jar mechanism as recited in claim 19, wherein said adjustment means includes:

seal means isolating said adjustment teeth and adjustment aperture from said protective chamber and preventing possible contamination of said protective chamber by contaminants that enter said housing structure through said adjustment aperture.

24. A downhole jar mechanism as recited in claim 19, wherein said pressure balancing and volume compensating means comprises:

a pressure balancing and volume compensation chamber being defined between said housing structure and said operator mandrel; and closure means being received in movable relation within said pressure balancing and volume compensation chamber and defining a movable closure for said protective chamber, said closure means moving to compensate for volumetric changes within said protective chamber and maintaining pressure within said protective chamber balanced with fluid pressure externally of said protective chamber.

25. A downhole jar mechanism as recited in claim 24, wherein said closure means comprises:

a piston being movably disposed within said pressure balancing and volume compensation chamber and being in sealed relation with both said housing structure and said operator mandrel.

26. A downhole jar mechanism as recited in claim 19, wherein:

said operator mandrel is enabled to be moved downwardly at any desired speed to cause downwardly directed jarring impact between said operator mandrel and said housing structure, thereby allowing both upward and downward directed jarring forces to be selectively transmitted through said housing structure to the stuck object under conditions of selectively controlled impact forces.

27. The downhole jar mechanism as claimed in claim 10, including:

means for selectively adjusting said compression of said spring and thereby selecting the impact force delivered by said striker means against said anvil and thus the jarring force transmitted through said housing structure to said object.

* * * * *